United States Patent [19]

Sturm

[11] 4,225,285

[45] Sep. 30, 1980

[54] AXIAL-FLOW FAN

[75] Inventor: Gerhard Sturm, Mulfingen, Fed. Rep. of Germany

[73] Assignee: EBM Elektrobau Mulfingen GmbH & Co., Mulfingen, Fed. Rep. of Germany

[21] Appl. No.: 943,168

[22] Filed: Sep. 18, 1978

[30] Foreign Application Priority Data

Sep. 22, 1977 [DE] Fed. Rep. of Germany ..... 2742734

[51] Int. Cl.[3] ..... F04B 35/04; F04D 29/54

[52] U.S. Cl. ..... 415/207; 415/213 C; 417/354

[58] Field of Search ..... 417/352, 353, 354, 423 R; 415/207, 213 C, 219 R, 210, 2 A; 60/221

[56] References Cited

U.S. PATENT DOCUMENTS 2,611,533 9/1952 Herrman et al. ..... 415/207

3,334,807 8/1967 McMahan ..... 415/219 R

FOREIGN PATENT DOCUMENTS 2652642 5/1978 Fed. Rep. of Germany ..... 415/213 C 280591 11/1927 United Kingdom ..... 415/210

*Primary Examiner*—Leonard E. Smith

*Attorney, Agent, or Firm*—Michael J. Striker

[57] ABSTRACT

An axial-flow fan includes an impeller and a supporting member, a hollow elongated casing having a circumferential wall, an inlet and an outlet axially spaced from the inlet and defining with the circumferential wall the interior of the casing accommodating the impeller and the supporting member. The circumferential wall comprises a first conical annular portion adjacent to the inlet and diverging in the direction from the outlet to the inlet, a second conical annular portion adjacent to the outlet and diverging in the direction from the inlet to the outlet.

7 Claims, 3 Drawing Figures

AXIAL-FLOW FAN

BACKGROUND OF THE INVENTION

The present invention relates to air-flow fans. More particularly this invention concerns axial-flow fans.

It is known in the art of axial-flow fans to accommodate an impeller within the interior of a casing which has quadrangular outer faces. Such a casing has two opposite end portions, at the inlet and outlet sides of the casing relatively, which are enlarged so as to increase the interior of the casing correspondingly.

Such casings are described in German Pat. No. 1,728,338; U.S. Pat. Nos. 1,642,205; 2,144,035; 1,107,916; 1,719,255; 2,142,307; 2,926,838; 3,029,870; etc.

However, it has been recognized that these constructions are not satisfactory with respect to the requirements made as to optimum utilization of the interior of the casings.

SUMMARY OF THE INVENTION

It is a general object of the present invention to avoid the disadvantages of the prior art axial-flow fans.

More particulary, it is an object of the present invention to provide such a casing for accommodating an impeller with optimum utilization of the interior of such a casing to thereby reduce the manufacturing costs of the casing.

In pursuance of these objects and others which will become apparent hereafter, one feature of the present invention resides in providing an axial-flow fan comprising an impeller means having a predetermined axial length and including an impeller and a supporting member, a hollow elongated casing having a circumferential wall, an inlet and outlet axially spaced from the inlet and defining together with the circumferential wall the interior of the casing accommodating the impeller means. The interior has an axial length corresponding to said predetermined length of the impeller means, whereby substantially the whole axial length of the interior of the casing is taken up by said impeller means. The circumferential wall comprises a first conical annular portion adjacent to the inlet and diverging in the direction from the outlet to the inlet and defining the first maximum cross-sectional dimension of said interior at said inlet of the casing. The circumferential wall further comprises a second conical annular portion adjacent to the outlet and diverging in the direction from the inlet to the outlet and defining the second maximum cross-sectional dimension of said interior at the outlet of the casing. One of the main advantageous features of the present invention resides in the fact that the second maximum cross-sectional dimension of the casing exceeds said first maximum cross-sectional dimension.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
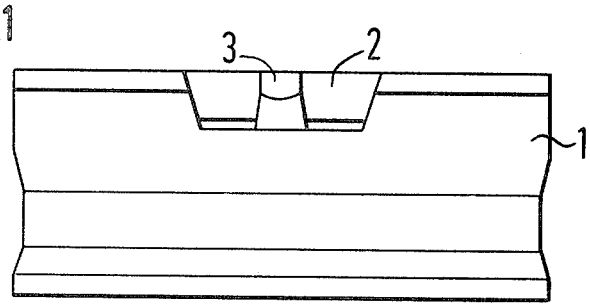
FIG. 1 is a side view of an axial-flow fan in accordance with the present invention.
Figure 2:
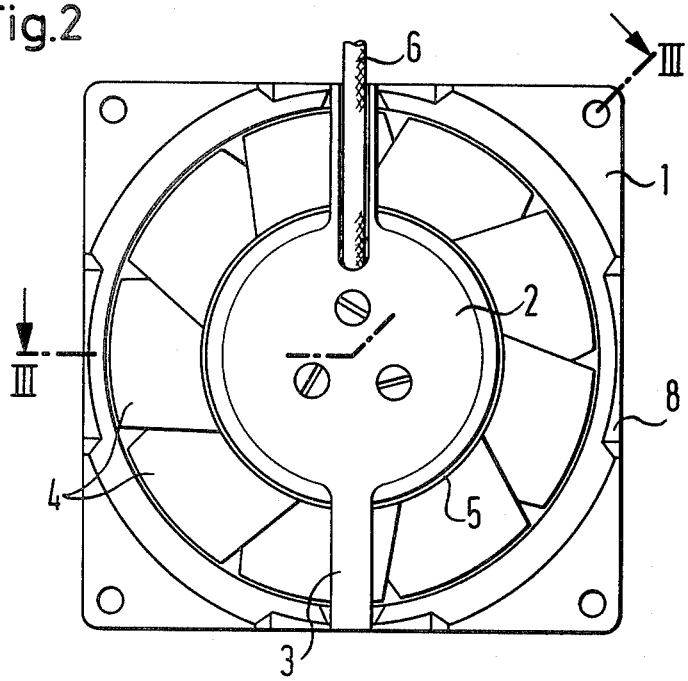
FIG. 2 is a front view of the axial-flow fan.
Figure 3:
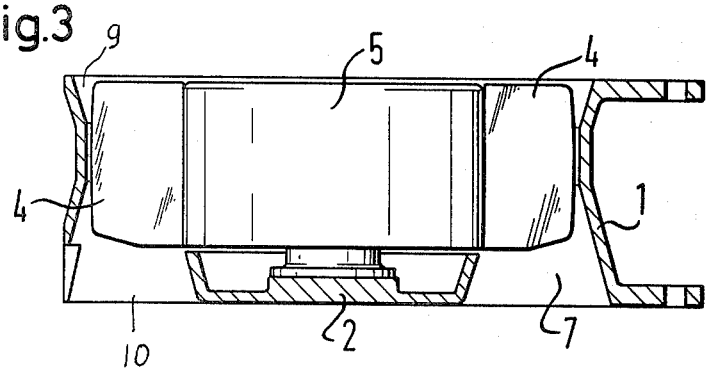
FIG. 3 is a sectional view taken along the line III—III on FIG. 2.

Referring now to the drawings and first to the FIG. 3 thereof, it may be seen that the reference numeral 4 designates an impeller provided with a corresponding motor 5 of the external rotor type. A casing 1 (see FIGS. 1 through 3) is provided to accommodate in the interior 7 thereof the impeller 4 with the motor 5, at least one supporting member 3 (see FIG. 2) and a shield 2 connected to the motor 5. The interior 7 of the casing 1 has such dimensions as to be substantially fully taken up by the impeller 4 with elements 2 and 3 when they are accommodated in the casing 1.

The circumferential wall has an intermediate cylindrical portion, a first conical annular portion adjacent to the inlet 9 of the casing 1, and a second conical annular portion adjacent to the outlet 10 of the casing 1. The first conical annular portion diverges in direction from the outlet 10 to the inlet 9, so as to define the first maximum diameter at the inlet 9. The second conical annular portion diverges in direction from the inlet 9 to the outlet 10, so as to define the second maximum diameter at the outlet 10. The second maximum diameter is larger than the first maximum diameter by 1% to 4%.

The cylindrical portion defines a part of the interior 7 which constitutes from 5% to 20% of the whole interior. The axial dimensions of the second, intermediate and first portions relate to one another in the order (i.e., ratio) of 8:7:4.

Such a shape of the casing 1 renders it possible to more efficiently use the interior 7 of the casing, since it provides the enlarged portions, that is first and second conical portions, only there where they are really indispensable. However, these portions with regard to the mutual relation differ very little from the cylindrical portion, and therefore its influence on the air stream running through the fan is negligible.

Such small conical portions of the casing practically do not necessitate any departure of the overall shape of the casing from the usual circular form. The axial side portions of the circumferential wall of the casing 1 are provided with recesses 8 which have to be maintained due to the casting technique in order to ensure sufficient thickness of the wall of the casing 1. These recesses 8 do not, however, substantially change the overall shape of the casing 1 from the usual circular form.

Such a shape of the casing 1 is of importance in practice because it gives the best optimum space for directing the air flow. Besides that, the casing itself is very inexpensive in manufacturing, especially due to the circular form of the casing. It is also to be mentioned, that such inexpensive casing makes the whole axial-flow fan considerably less expensive in manufacturing.

Another advantageous feature of the present invention resides in providing the casing with at least one circular connecting portion. Thus, should one use a ventilator with a quadrangular outlet or with inclined angle walls, then an adapter may be used which will adjust the quadrangular form of the outlet of the ventilator to the circular connecting portion of the casing. It is to be understood that such an adapter is not expensive and space consuming. If such a precaution is not made, then the respective diffusor may not be operative or one portion of the exhaust diffusor may become obstructed. However, since the adapter is inexpensive, this does not detract from the advantages of the invention, in terms of reduced manufacturing costs.

It is also to be mentioned, that the recesses 8 do not practically prevent any normal flow stream through the casing. Therefore, there is no need to make any changes of the respective dimensions of the casing to thus compensate for these recesses.

It will be understood that each of the elements described above, or two or more together, may also find a useful application in other types of axial-flow fans differing from the types described above.

While the invention has been illustrated and described as embodied in an axial-flow fan, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An axial-flow fan, comprising an impeller means having a predetermined axial length and including an impeller and a supporting member, and a hollow elongated casing having a circumferential wall, an inlet and an outlet axially spaced from said inlet and defining together with said circumferential wall the interior of said casing accommodating said impeller means, said interior having an axial length corresponding to said predetermined length of said impeller means, whereby substantially the whole axial length of the interior of the casing is taken up by said impeller means, said circumferential wall comprising a first conical annular portion adjacent to said inlet and diverging in the direction from said outlet to said inlet and defining the first maximum cross-sectional dimension of said interior at said inlet of the casing, a second conical annular portion adjacent to said outlet and diverging in the direction from said inlet to said outlet and defining the second maximum cross-sectional dimension of said interior at said outlet of the casing, and an intermediate portion interposed between said first conical annular portion and said second conical annular portion, the axial dimensions of said second, intermediate and first portions being in proportion to each other in the order of 8:7:4.

2. An axial-flow fan, comprising an impeller means having a predetermined axial length and including an impeller and a supporting member, and a hollow elongated casing having a circumferential wall, an inlet and an outlet axially spaced from said inlet and defining together with said circumferential wall the interior of said casing accommodating said impeller means, said interior having an axial length corresponding to said predetermined length of said impeller means, whereby substantially the whole axial length of the interior of the casing is taken up by said impeller means, said circumferential wall comprising a first conical annular portion adjacent to said inlet and diverging in the direction from said outlet to said inlet and defining the first maximum cross-sectional dimension of said interior at said inlet of the casing, a second conical annular portion adjacent to said outlet and diverging in the direction from said inlet to said outlet and defining the second maximum cross-sectional dimension of said interior at said outlet of the casing, and an intermediate portion interposed between said first conical annular portion and said second conical annular portion, said intermediate portion constituting from 5% to 20% of the whole interior of the casing.

3. An axial-flow fan, comprising an impeller means having a predetermined axial length and including an impeller and a supporting member, and a hollow elongated casing having a circumferential wall, an inlet and an outlet axially spaced from said inlet and defining together with said circumferential wall the interior of said casing accommodating said impeller means, said interior having an axial length corresponding to said predetermined length of said impeller means, whereby substantially the whole axial length of the interior of the casing is taken up by said impeller means, said circumferential wall comprising a first conical annular portion adjacent to said inlet and diverging in the direction from said outlet to said inlet and defining the first maximum cross-sectional dimension of said interior at said inlet of the casing, a second conical annular portion adjacent to said outlet and diverging in the direction from said inlet to said outlet and defining the second maximum cross-sectional dimension of said interior at said outlet of the casing, and an intermediate portion interposed between said first conical annular portion and said second conical annular portion, said second maximum cross-sectional dimension of the casing exceeding said first maximum cross-sectional dimension from 1% to 4%.

4. A fan as defined in claim 3, wherein said casing is provided with end faces of quadrangular cross-section.

5. A fan as defined in claim 3, wherein said casing is a one-piece element.

6. A fan as defined in claim 3, wherein said intermediate portion has a cylindrical cross-section.

7. A fan as defined in claim 3, wherein said casing is provided with at least two recesses located axially along the length of the casing.

* * * * *